US008356874B2

(12) United States Patent
Mills

(10) Patent No.: US 8,356,874 B2
(45) Date of Patent: Jan. 22, 2013

(54) APPARATUS AND METHOD FOR PRECISION APPLICATION AND METERING OF A TWO-PART (BINARY) IMAGING SOLUTION IN AN INK JET PRINTER

(75) Inventor: Michael D. Mills, Moultonboro, NH (US)

(73) Assignee: Redwood Technologies, LLC, Moultonboro, NH (US)

( * ) Notice: Subject to any disclaimer, the term of this patent is extended or adjusted under 35 U.S.C. 154(b) by 334 days.

(21) Appl. No.: 12/706,057

(22) Filed: Feb. 16, 2010

(65) Prior Publication Data

US 2011/0199406 A1 Aug. 18, 2011

Related U.S. Application Data

(60) Provisional application No. 61/167,750, filed on Apr. 8, 2009.

(51) Int. Cl.
*B41J 2/205* (2006.01)

(52) U.S. Cl. ..... 347/15

(58) Field of Classification Search ..... 347/7, 14, 347/15, 21, 95, 96
See application file for complete search history.

(56) References Cited

U.S. PATENT DOCUMENTS

| | | | |
|---|---|---|---|
| 4,384,288 | A | 5/1983 | Walton |
| 4,599,627 | A | 7/1986 | Vollert |
| 4,926,187 | A | 5/1990 | Sugawara et al. |
| 5,444,223 | A | 8/1995 | Blarna |
| 5,574,470 | A | 11/1996 | de Vall |
| 5,604,485 | A | 2/1997 | Lauro et al. |
| 5,635,969 | A | 6/1997 | Allen |
| 5,838,253 | A | 11/1998 | Wurz et al. |
| 5,874,902 | A | 2/1999 | Heinrich et al. |
| 5,914,862 | A | 6/1999 | Ferguson et al. |
| 5,964,656 | A | 10/1999 | Lawler et al. |
| 5,995,006 | A | 11/1999 | Walsh |
| 6,019,461 | A | 2/2000 | Yoshimura et al. |
| 6,043,746 | A | 3/2000 | Sorrells |
| 6,078,259 | A | 6/2000 | Brady et al. |
| 6,097,301 | A | 8/2000 | Tuttle |
| 6,100,804 | A | 8/2000 | Brady et al. |
| 6,100,840 | A | 8/2000 | Zidek et al. |
| 6,104,281 | A | 8/2000 | Heinrich et al. |
| 6,206,282 | B1 | 3/2001 | Hayes et al. |
| 6,218,942 | B1 | 4/2001 | Vega et al. |
| 6,232,870 | B1 | 5/2001 | Garber et al. |
| 6,265,977 | B1 | 7/2001 | Vega et al. |
| 6,305,548 | B1 | 10/2001 | Sato et al. |
| 6,346,881 | B1 | 2/2002 | Davidson |
| 6,361,138 | B1 | 3/2002 | Seino et al. |
| 6,385,407 | B1 | 5/2002 | Inose |

(Continued)

FOREIGN PATENT DOCUMENTS

| | | |
|---|---|---|
| EP | 1060895 | 12/2000 |
| WO | 2008074589 | 6/2008 |

OTHER PUBLICATIONS

"RFID Hardware Settings", Date/Location: Unavailable, RFID Inc. STX Reader, pp. 1-3.

(Continued)

*Primary Examiner* — An Do
(74) *Attorney, Agent, or Firm* — Michael A. Glenn; Glenn Patent Group

(57) ABSTRACT

A multi-color ink jet printing system uses a two-part (Binary) imaging solution, where the precise mixture of the multiple fluid parts (Colorant(s) and Reactant) is controlled with the use of multiple drop size (Grey Scale) ink jet print heads. The precise mixture of colorant(s) and reactant initiates a chemical reaction, which cures the imaging solution into a solid or nearly solid compound that ensures proper drop location.

12 Claims, 4 Drawing Sheets

U.S. PATENT DOCUMENTS

| | | | |
|---|---|---|---|
| 6,533,383 | B1 | 3/2003 | Saruta et al. |
| 6,644,771 | B1 | 11/2003 | Silverbrook |
| 6,672,720 | B2 | 1/2004 | Smith |
| 6,808,255 | B1 | 10/2004 | Haines et al. |
| 6,938,976 | B2 | 9/2005 | Siwinski et al. |
| 7,431,436 | B1 | 10/2008 | Mills et al. |
| 2003/0043243 | A1 | 3/2003 | Trafton et al. |
| 2003/0081023 | A1 | 5/2003 | Miller et al. |
| 2004/0196347 | A1 | 10/2004 | Redding et al. |
| 2006/0279587 | A1 | 12/2006 | Furuichi et al. |
| 2007/0076050 | A1 | 4/2007 | Sugahara et al. |
| 2008/0273066 | A1 | 11/2008 | Hiroki et al. |

OTHER PUBLICATIONS

"RFID Inc. Installation and Operating Manual, Model SIR and Model SR2", Simple Writer, Version 3/00, Date/Location: Unavailable, pp. 1-10.

APPARATUS AND METHOD FOR PRECISION APPLICATION AND METERING OF A TWO-PART (BINARY) IMAGING SOLUTION IN AN INK JET PRINTER

CROSS REFERENCE TO RELATED APPLICATIONS

This application claims priority to U.S. provisional patent application Ser. No. 61/167,750, filed Apr. 8, 2009, which application is incorporated herein in its entirety by this reference thereto.

BACKGROUND OF THE INVENTION

1. Technical Field

The invention generally pertains to ink jet printers, and particularly, to such printers using a binary imaging solution and multiple drop size ink jet print head technology.

2. Description of the Prior Art

A binary imaging solution uses colorants that each comprise a mixture of two ink components, where the two components are combined at the time the colorant is applied to a recording surface. Traditionally, to use a binary imaging solution in an ink jet printer, one channel of colorant per channel of reactant is used to ensure proper mixture of the two-part solution. This implementation, although feasible, has never really seen wide range adoption due to the cost associated with ink jet print head assemblies. In effect, this implementation would require double the number of print heads as compared to a uniary imaging solution.

As the demand for higher print quality and speeds has progressed in digital ink jet printing, print head technology has progressed in kind, starting from airbrush technology, having print resolutions of 4-9 dpi, to the newer drop-on-demand ink jets, having print resolutions up to 2400 dpi. At the older resolutions of sub-10 dpi it did not take many print heads to deliver acceptable printing speed considering that the size of the printed dot was 1/10 of an inch. Now consider that to generate images in the range of 1200 dpi the drop size would need to be 1/1200 of an inch. When working with drop sizes so small it takes many more drops to get an acceptable fill pattern when working with solid colors. This can only be accomplished in one of two ways: populate more ink jets into the product to increase coverage per pass of the print head array; or interlace many more print head passes of the print head array with the same number of print heads. The first option would drive up printer cost to an unacceptable level, while the second option would drop productivity to unacceptable levels.

With the advancement in print head technology into grey scale functionality, the print head technology for grey scale functionality has provided an answer to this issue. These print heads generate multiple drop sizes from the same nozzle assembly. Therefore, one can generate a larger drop size when a good solid fill pattern is needed and a smaller drop size when higher detail is needed.

Prior to the introduction of grey scale print head technology the application of a binary imaging fluid was somewhat hampered also. For example, a traditional ink jet printer may have four color channels, including Cyan, Magenta; Yellow and blacK (CMYK). Other color channels employing colors such as White, Blue, Red, Orange and Green may also be used to increase functionality and color gamut. For these examples it is assumed that a printer uses seven color channels, one each for Cyan, Magenta, Yellow, blacK, White, Blue, and Red, (CMYKWBR).

In traditional methods, for the application of binary solutions one of two options is selected. The first option is to use only one channel of reactant (CMYKWBRr), whereby one drop of reactant is applied to a location in an 'OR' methodology, where it would be applied to any drop location that is slated to receive, or already has received, a colorant drop. This method, although acceptable for a surface preparation type of implementation or an over coating application, is not effective for accurate metering of the binary mixture ratio. This is because each printed location could have anywhere from one to seven colorant drops placed in that location and only one drop of reactant. The ratio of reactant to colorant drops, assuming similar drop sizes, could be anywhere from 1:7 to 1:1. This is the method taught by Allen (U.S. Pat. No. 5,635,969), whereby the reactant channel is used as a pre coat for the colorant to control dot gain and other print artifacts.

A second option would be to have one channel of reactant per channel of colorant to provide for accurate mixing of the solution (CrMrYrKrWrBrRr). To provide the same speed and functionality as the previous example it would require 14 separate channels to provide accurate ratio metering at speed. This method is taught by Vollert (U.S. Pat. No. 4,599,627), whereby every drop of colorant is matched to a single drop of reactant to ensure a consistent ratio.

Although this solution is functional in providing an accurate mixture of the binary solutions in a controlled ratio, it is largely cost prohibitive due to the volume of additional print heads needed and ancillary equipment needed to support them as compared to uniary print systems.

Thus, a heretofore unaddressed need exists in the industry to address the aforementioned deficiencies and inadequacies in connection with binary imaging.

SUMMARY OF THE INVENTION

An embodiment of the invention comprises a method and apparatus for applying a binary imaging solution to a print media in such a way as to provide for accurate ratio metering of two parts of the imaging solution. By exploiting grey scale print head technology in the application of binary imaging solutions to a medium, it is possible to meter a more precise mixture ratio of the two parts with the addition of only one or possibly two jetting channels of reactant for multiple color channels.

In the preferred embodiment of the invention, the ink jet printer may have, for example, seven color channels including Cyan, Magenta, Yellow, blacK, White, Blue, and Red, and one or two channels for reactant (rCMYKWBRr') or (rCMYKWBR). Metering of the proper ratio of colorant to reactant is accomplished by calculating a summed total volume of colorant drops applied to a particular location and adjusting the drop sizes generated by the reactant channel, or both channels in the case of multiple channels, to apply the proper mixture ratio of the solutions. The use of multiple channels, for example, two channels also aids in the mixing of the solutions by adjusting the order in which the colorants and reactant are applied to the drop location.

DETAILED DESCRIPTION OF THE INVENTION

An embodiment of the invention comprises a method and apparatus for the precise metering of a binary imaging solution to each pixel location of an ink jet image on a substrate. The two parts of the binary imaging solution, when combined in the proper ratio, initiate a chemical curing reaction the causes the fluid to transform into a solid or near solid state in a predetermined amount of time. Additionally the chemical reaction of the two fluids causes the material to bond with the substrate and allow for consistent adhesion and imaging characteristics.

Figure 1:
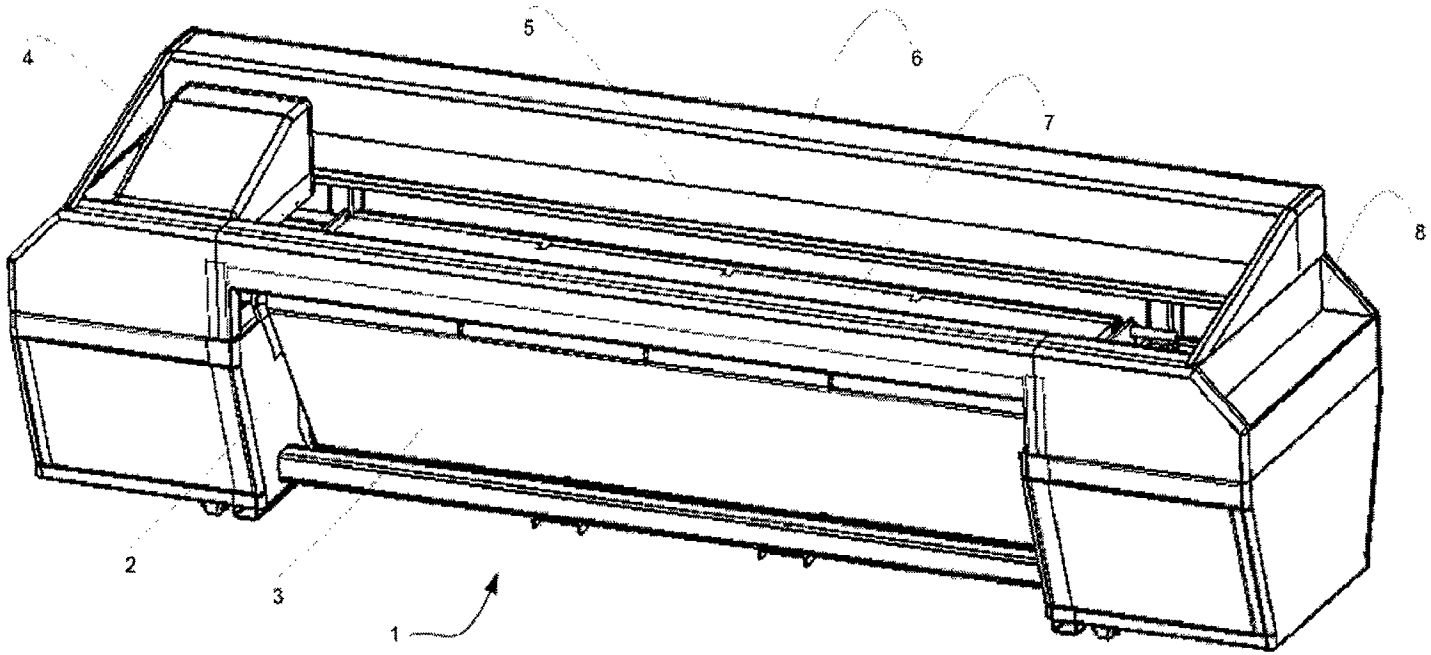
FIG. 1 is a perspective view of a printing system in accordance with the invention.

FIG. 1 shows a printing system, generally identified as 1, provided with a carriage 4. The bottom surface of the carriage holds a series of grey scale ink jet print heads configured for printing images on a variety of substrates. Typical substrates include both flexible and non-flexible substrates, such as textiles, polyvinyl chloride (PVC), reinforced vinyl, polystyrene, glass, wood, foam board, and metals.

Figure 2:
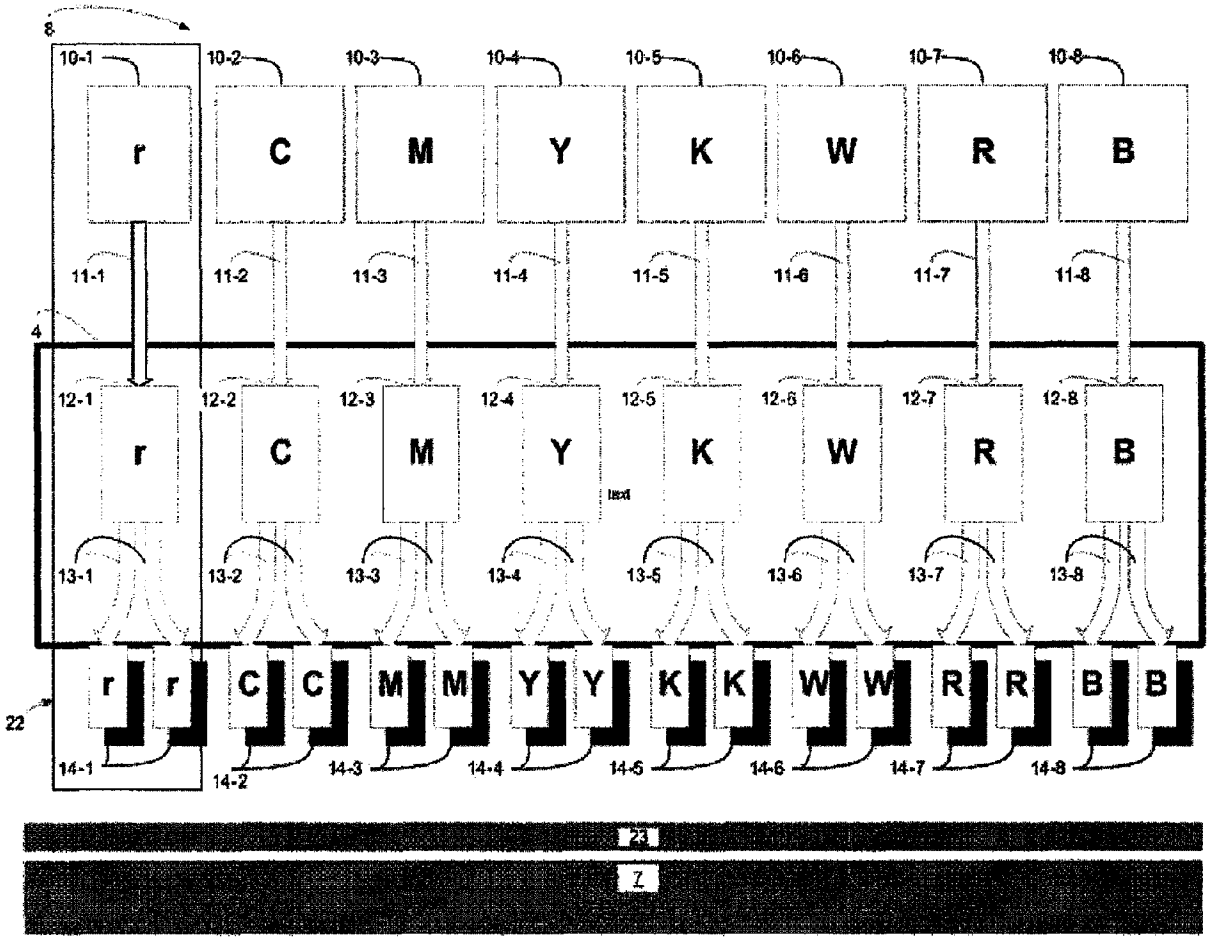
FIG. 2 is a schematic view of a carriage of the printing system of FIG. 1 having a plurality of print heads and one reactant channel in accordance with the invention.

In addition to the carriage 4, the printing system 1 includes a base frame 2, a substrate transport belt 3 that is used to transport a substrate 23 (FIG. 2), which is held to the top of the transport belt 3 through the depth of print platen area 7, and a rail system 5 that is attached to the base frame 2. The carriage 4 is transported along the rail system 5, thus providing a motion path oriented perpendicular to the substrate transport direction and parallel to the surface of the print platen area 7. The carriage motion along the rail system 5 is facilitated by an appropriate motor drive system, thus allowing it to traverse the width of the print platen area 7 at a reasonably controlled rate of speed. Accordingly, the transport belt 3 intermittently moves the substrate 23 (FIG. 2) through the depth of the print platen area 7 in such a way that the carriage 4 is allowed to traverse back and forth over the substrate 23 (FIG. 2) and deposit imaging solution droplets onto the substrate 23 (FIG. 2) via a series of multiple drop size, also referred to as grey scale, ink jet print heads 14 (FIG. 2).

Grey scale print heads 14 typically have a native drop volume, which is the smallest drop volume that can be deposited by the head. These print heads facilitate the application of variable drop sizes to the substrate 23 in a particular pixel location by applying multiples of the native drop volume to a pixel location. For example, if the native drop volume of a particular print head is 10 pico-liters (0.000000000010 liters) and has four grey levels, i.e. the native drop volume multiplied by 0, 1, 2, and 3, then the available drop sizes for that print head are 0 pl, 10 pl, 20 pl, and 30 pl, respectively.

After a carriage pass is completed and a portion of the image is applied to the substrate, the substrate is indexed, or stepped, again via the transport belt 3 and located accurately for the next pass of the carriage 4 and the next portion of the image to be printed. This process is repeated until the entire image is applied to the print substrate.

The series of print heads 14 (FIG. 2) receives one or more colored imaging solutions (colorants) as well as one or more channels of reactant from a set of secondary fluid containers 12 (FIG. 2) which are also mounted in the carriage 4. In addition, a set of primary fluid containers 10 (FIG. 2) supply the colorants and reactant to the secondary fluid containers. Unlike the secondary fluid containers 12 (FIG. 2), the primary fluid containers 10 (FIG. 2) are located remotely from the carriage 4, for example, on a shelf 8 located on the frame structure 2. The base frame 2 and rail system 5 is typically covered by a system of covers 6 for safety and aesthetic reasons.

FIG. 2 shows in more detail the fluid delivery path from primary fluid tanks 10-1 to 10-8 to a series of grey scale print heads 14-1 to 14-8 associated with each imaging fluid (both colorants and reactant) for a system with a single channel of reactant. The series of print heads 14-1 to 14-8 may contain a single print head or a plurality of print heads. Each series of print heads 14-1 to 14-8 is in fluid communication with its associated secondary fluid tank 12-1 to 12-8 via a manifold delivery system 13-1 to 13-8. Likewise, the imaging fluids are delivered from primary fluid containers 10-1 to 10-8 to secondary fluid tanks 12-1 to 12-8 via a series of delivery tubing, filters, and pump systems illustrated in FIG. 2 as 11-1 to 11-8. Accordingly, by depositing various droplets of colorants and reactant onto the substrate 23, which is held in place by the transport belt 7, in the appropriate pixel locations, the desired image is formed. The fluids are combined on the substrate 23 through impingement mixing and allowed to cure chemically.

A fluid channel 22 is considered a single fluid path from start to finish including the primary fluid tank 10, the delivery system 11, the secondary fluid tank 12, the manifold delivery system 13, and an associated series of print heads 14.

Figure 3:
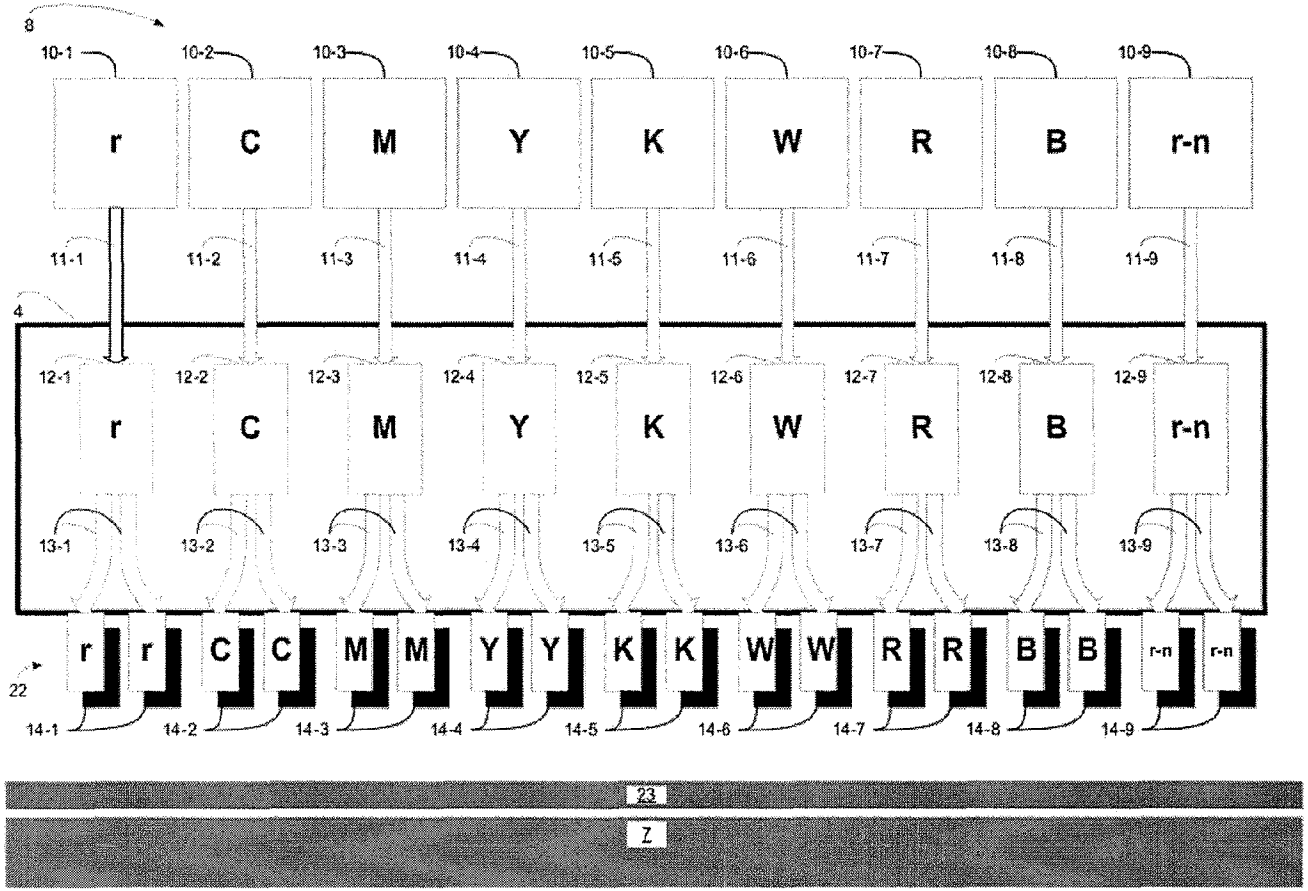
FIG. 3 is a schematic view of a carriage of the printing system of FIG. 1 having a plurality of print heads and multiple (n) reactant channels in accordance with the invention.

Note that the invention is not limited to the colors, number of color fluid channels, or color order and orientation illustrated in FIG. 2. The colorant fluid channels and the reactant fluid channel orientation vary by application. Therefore, the orientation and order shown is for illustration purposes only. As shown in FIG. 3, more than one reactant fluid channel can also be used, up to one less channel than the number of colorant fluid channels in use.

Figure 4:
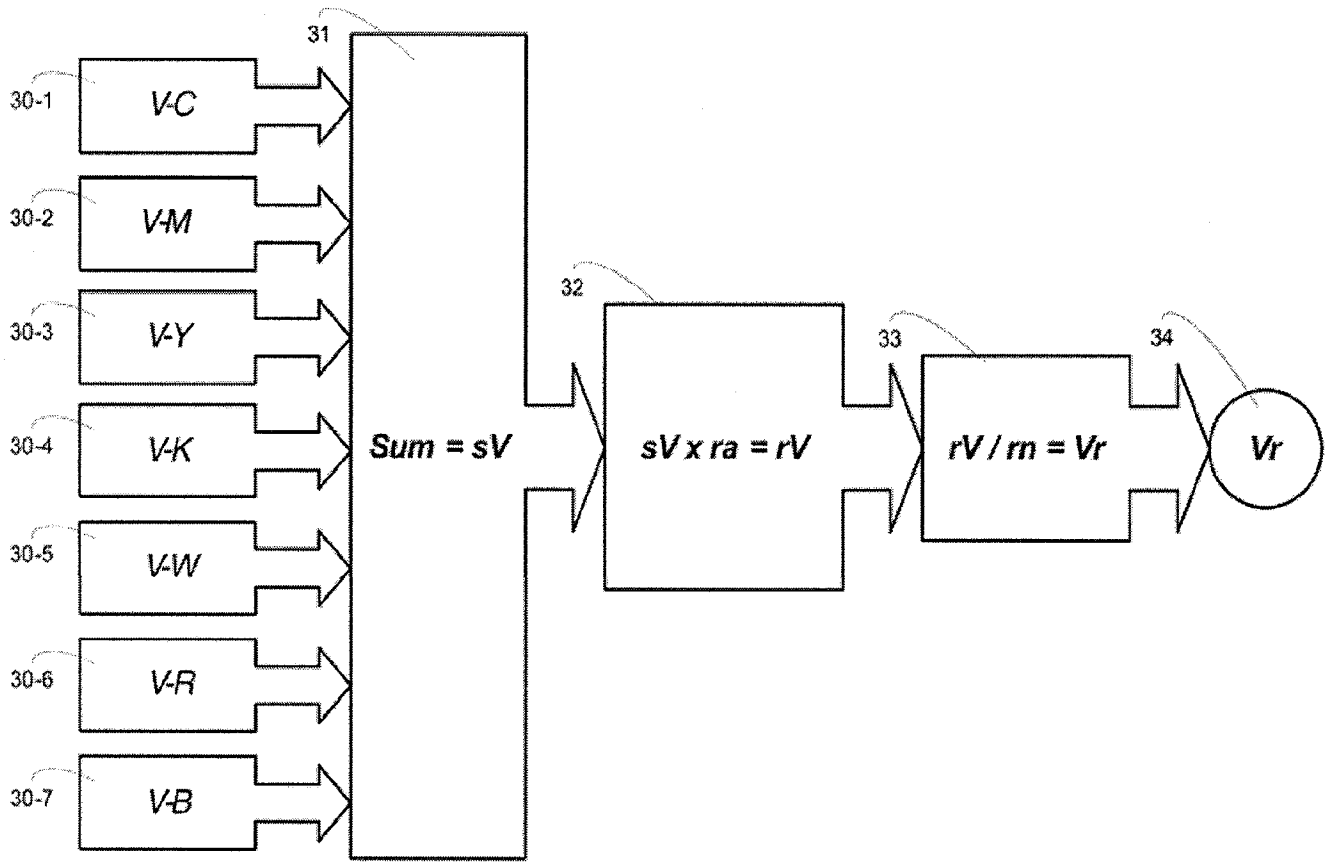
FIG. 4 is a simplified functional block diagram illustrating an algorithm that inputs the printing of a volume of multiple colorants, sums it, multiplies it with a mixture ratio to reactant, and determines the volume to be deposited via each reactant channel in accordance with the invention.

FIG. 4 shows a graphical representation of an algorithm to be executed in a computing device containing a processor and memory, both sized appropriately to accommodate the image size in question. This algorithm allows the computing device to determine the sum total volume of colorant that is to be applied to a pixel location by all the colorant channels and multiplies it by the mixture ratio to determine the proper volume of reactant to be applied to the same pixel location. If the volume of reactant is larger than the volume that can be applied by a single channel of reactant, or if a better granularity of the mixture ratio can be achieved by distributing the volume of reactant to different drop sizes across multiple channels, the algorithm distributes the volume of reactant accordingly.

The volume of each colorant 30-1 to 30-7 to be deposited to a particular pixel location is additively summed in function block 31 and represented by the variable sV for summed Volume. This summed volume (sV) is then multiplied in function block 32 by a proper mixture ratio (ra) to determine the total volume of reactant needed, represented by the variable rV. The proper mixture ratio (ra) is determined by the chemical properties of the binary printing solution and supplied by the manufacturer of said solution.

If the reactant channels in the printer are configured with print heads of the same drop volume, then the volume of reactant needed for the pixel location, represented by the variable rV, is then divided in function block 33 by the number of reactant fluid channels (rn) used in the printer system, resulting in the volume of reactant (Vr) to be deposited by each reactant channel 34 used in the printer.

The reactant channels in the printer may also be configured with print heads of different native drop volumes. If the printer is configured in this way then the volume of reactant to be deposited by each channel to a particular pixel location is adjusted according to the drop volumes of the print heads used in each channel. This configuration can be used to obtain the optimal granularity of mixture ratios possible with the given drop volumes delivered by various print heads.

Note that the invention is not limited to the colors, or number of colors in FIG. 4, and more than one reactant fluid channel can also be used, up to one less channel than the number of colorant fluid channels used.

An important consideration in practicing the invention is the fact that the reactant is not a surface preparation material and may be deposited before, after, or in between colorant drops. As long as the droplets are given ample opportunity for impingement mixing, and the proper mixture ratio is achieved, the two components of the binary imaging solution may be applied in any order or, in some cases, depending on the characteristics of the imaging solution, portions of the colorant and reactant may be applied in a specific order to accelerate the impingement mixing.

Although the invention is described herein with reference to the preferred embodiment, one skilled in the art will readily appreciate that other applications may be substituted for those set forth herein without departing from the spirit and scope of the present invention. Accordingly, the invention should only be limited by the claims included below.

The invention claimed is:

1. A method of applying a binary imaging solution to a print media, comprising the steps of:

determining with a processor an amount of colorant that is to be applied by at least one grey scale print head to a pixel location on the print media;

determining with said processor an amount of reactant that is to be applied by at least one grey scale print head to the pixel location on the print media to provide the colorant and the reactant in a predetermined ratio, wherein the predetermined ratio comprises a characteristic of said colorant and said reactant that is necessary for proper chemical curing of the imaging solution; and applying the colorant and the reactant to the print media at the pixel location in accordance with the predetermined ratio;

wherein the colorant and the reactant are combined on the print media through impingement mixing and allowed to cure chemically.

2. The method of claim 1, further comprising the step of:

using a drop volume variability characteristic of said at least one grey scale print head when applying the colorant and the reactant to the print media in accordance with the predetermined ratio.

3. The method of claim 1, further comprising the step of:

using a variability of drop volume characteristic of said at least one grey scale print head to order application of fluid droplets of the colorant and the reactant to the pixel location to provide optimal impingement mixing of the binary imaging solution when applying the colorant and the reactant to the print media in accordance with the predetermined ratio.

4. The method of claim 1, wherein said reactant is not a surface preparation material and may be deposited before, after, or in between colorant drops.

5. The method of claim 1, wherein more than one reactant fluid channel can also be used, up to one less channel than a number of colorant fluid channels used.

6. The method of claim 1, further comprising the steps of:

providing a plurality of reactant channels that are configured with print heads of different native drop volumes; and adjusting the volume of reactant to be deposited by each channel to a particular pixel location according to the drop volumes of the print heads used in each channel to obtain an optimal granularity of mixture ratios possible with the given drop volumes delivered by various print heads.

7. An apparatus for applying a binary imaging solution to a print media, comprising:

a processor configured for determining an amount of colorant that is to be applied by at least one grey scale print head to a pixel location on the print media;

said processor configured for determining an amount of reactant that is to be applied by at least one grey scale print head to the pixel location on the print media to provide the colorant and the reactant in a predetermined ratio, wherein the predetermined ratio comprises a characteristic of said colorant and said reactant that is necessary for proper chemical curing of the imaging solution; and at least one print head for applying the colorant and the reactant to the print media at the pixel location in accordance with the predetermined ratio;

wherein the colorant and the reactant are combined on the print media through impingement mixing and allowed to cure chemically.

8. The apparatus of claim 7, further comprising:

said processor configured for using a drop volume variability characteristic of said at least one grey scale print head when applying the colorant and the reactant to the print media in accordance with the predetermined ratio.

9. The apparatus of claim 7, further comprising:

said processor configured for using a variability of drop volume characteristic of said at least one grey scale print head to order application of fluid droplets of the colorant and the reactant to the pixel location to provide optimal impingement mixing of the binary imaging solution when applying the colorant and the reactant to the print media in accordance with the predetermined ratio.

10. The apparatus of claim 7, wherein said reactant is not a surface preparation material and may be deposited before, after, or in between colorant drops.

11. The apparatus of claim 7, wherein more than one reactant fluid channel can also be used, up to one less channel than a number of colorant fluid channels used.

12. The apparatus of claim 7, further comprising:

a plurality of reactant channels that are configured with print heads of different native drop volumes; and said processor configured for adjusting the volume of reactant to be deposited by each channel to a particular pixel location according to the drop volumes of the print heads used in each channel to obtain an optimal granularity of mixture ratios possible with the given drop volumes delivered by various print heads.

* * * * *